US007123282B2

(12) United States Patent
Fields et al.

(10) Patent No.: US 7,123,282 B2
(45) Date of Patent: Oct. 17, 2006

(54) METHOD AND APPARATUS FOR MINIMIZING VISUAL ARTIFACTS IN IMAGES GENERATED BY AN ELECTROPHOTOGRAPHIC MACHINE

(75) Inventors: Thomas A. Fields, Winchester, KY (US); Craig E. Hadady, Lexington, KY (US); Christopher D. Jones, Georgetown, KY (US); Philip J. Heink, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 374 days.

(21) Appl. No.: 10/757,130

(22) Filed: Jan. 14, 2004

(65) Prior Publication Data

US 2005/0151827 A1 Jul. 14, 2005

(51) Int. Cl.
*B41J 2/47* (2006.01)

(52) U.S. Cl. ..... 347/240; 347/251

(58) Field of Classification Search ..... 347/233–235, 347/248–250, 131, 240, 251–254; 345/596, 345/419; 358/1.12, 1.9, 3.03, 3.1, 3.3, 534–536; 399/180–181

See application file for complete search history.

(56) References Cited

U.S. PATENT DOCUMENTS

| | | | | |
|---|---|---|---|---|
| 5,016,191 | A * | 5/1991 | Radochonski | 345/596 |
| 5,170,215 | A | 12/1992 | Pfeuffer | |
| 5,181,137 | A | 1/1993 | Koide | |
| 5,819,149 | A | 10/1998 | Watanabe et al. | |
| 6,229,555 | B1 | 5/2001 | Hadady et al. | |
| 6,816,269 | B1 * | 11/2004 | Loce et al. | 358/1.12 |
| 6,917,443 | B1 * | 7/2005 | Wang | 358/1.9 |

* cited by examiner

*Primary Examiner*—Hai Pham

(74) *Attorney, Agent, or Firm*—Taylor & Aust, PC

(57) ABSTRACT

A method of minimizing visual artifacts resulting from a laser scan process in an electrophotographic machine, the electrophotographic machine including a photoconductive device having an image forming surface. The method including the steps of obtaining correction data relative to a bowed image and offsetting at least a portion of non-bowed image data dependent upon the correction data, and additionally dependent upon halftone cell growth of a halftone cell.

20 Claims, 9 Drawing Sheets

METHOD AND APPARATUS FOR MINIMIZING VISUAL ARTIFACTS IN IMAGES GENERATED BY AN ELECTROPHOTOGRAPHIC MACHINE

BACKGROUND OF THE INVENTION

1. Field of the Invention

The present invention relates to an electrophotographic machine, and, more particularly, to a method and apparatus for minimizing visual artifacts in images resulting from laser scan processing.

2. Description of the Related Art

In an in-line color electrophotographic imaging process, latent images are formed on a plurality of photosensitive drums, which are in turn developed using a predetermined color of toner. The developed images are transferred to an intermediate transfer device or directly to a sheet of media, such as paper, which travels past the photosensitive drums. Each color image is created one line at a time and the lines are oriented at right angles to the direction of travel of the intermediate transfer device or the paper. The individually generated images on each drum are combined on the paper to form a single full-color image. In a typical multi-color laser printer, for example, the sheet of paper passes through four color-developing stations in series, with the colors being black, magenta, cyan and yellow.

It is recognized that in order for the multi-color laser printer to accurately print an image, the laser beam, or beams, for each of the four colors must be in alignment, both in the scan direction (across the page) and in the process direction (feed direction of the paper). Providing proper alignment of the laser printheads relative to the sheet of media in each direction can be difficult. This problem is compounded with the addition of each printhead, since the plurality of printheads must be in registration so that the individual images generated by each printhead can be correctly superimposed when they are combined.

In order to reduce the cost of a laser printer a single scanning polygon mirror may be utilized to reflect the laser beams from multiple laser sources. Laser beams are directed through an optical system that includes lenses and mirrors. The optical path taken by the laser beams are offset in a single polygon mirror system. As such, as the laser light passes through some of the optics there can be a bending or bowing of the light as it travels across its scan.

What is needed in the art is a method and apparatus for minimizing artifacts and images resulting from laser scan process directional errors, such as printhead skew and laser beam bow.

SUMMARY OF THE INVENTION

The present invention provides a method and apparatus for minimizing visual artifacts resulting from laser scan process direction positional errors such as what may be induced by a bowing of the laser beam.

The invention comprises, in one form thereof, a method of minimizing visual artifacts resulting from a laser scan process in an electrophotographic machine, the electrophotographic machine including a photoconductive device having an image forming surface. The method including the steps of obtaining correction data relative to a bowed image and offsetting at least a portion of non-bowed image data dependent upon the correction data, and additionally dependent upon halftone cell growth of a halftone cell.

An advantage of the present invention is that the scan path of a laser beam of a multi-color laser printer can be corrected for scan line bowing.

Another advantage is that the image resulting from the operation of the invention minimizes visual artifacts.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
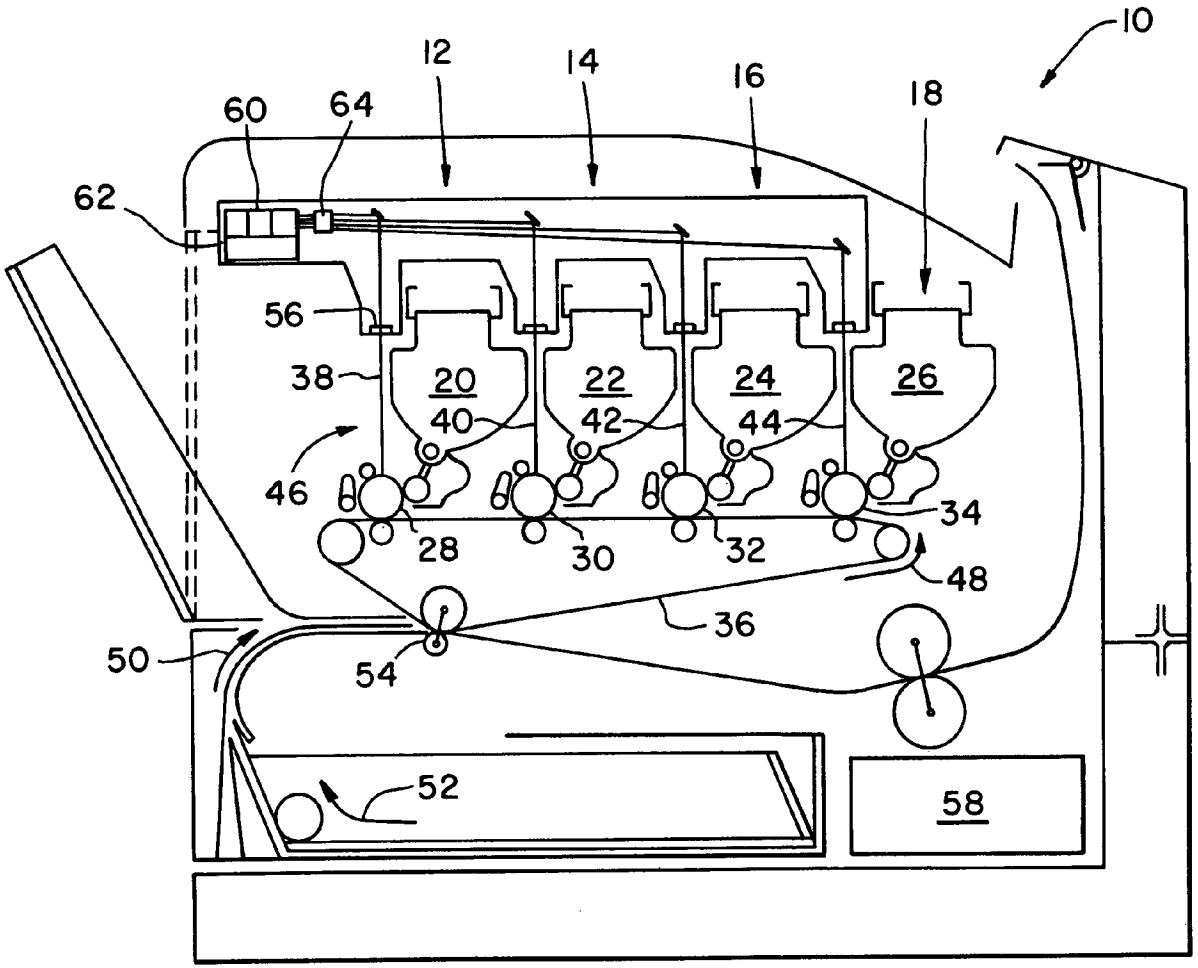
FIG. 1 is a side, sectional view of a multi-color laser printer embodying the present invention.

Referring now to the drawings and, more particularly to FIG. 1, there is shown one embodiment of a multi-color laser printer 10 including laser printhead portions 12, 14, 16, 18, a black toner cartridge 20, a magenta toner cartridge 22, a cyan toner cartridge 24, a yellow toner cartridge 26, photoconductive drums 28, 30, 32, 34, and intermediate transferor member belt 36.

Each of laser printhead portions 12, 14, 16 and 18 include optical components which reflect and/or direct a laser beam 38, 40, 42 and 44 in a scan direction, perpendicular to the plane of FIG. 1, across a respective one of photoconductive drums 28, 30, 32 and 34. Each of photoconductive drums 28, 30, 32 and 34 is negatively charged to approximately −900 volts and is subsequently discharged to a level of approximately −200 volts in the areas of its peripheral surface that are impinged by a respective one of laser beams 38, 40, 42 and 44 to form a latent image thereon made up of a plurality of dots, pixels or pels.

During each scan of a laser beam across a photoconductive drum, each of photoconductive drums 28, 30, 32 and 34 is continuously rotated, clockwise in the embodiment shown, in a process direction indicated by direction arrow 46. The scanning of laser beams 38, 40, 42 and 44 across the peripheral surfaces of photoconductive drums 28, 30, 32 and 34 is cyclically repeated, thereby discharging the areas of the peripheral surfaces on which the laser beams impinge.

The toner in each of toner cartridges 20, 22, 24 and 26 is negatively charged and is conveyed by an electrically conductive roller. During the printing operation, the conveyance roller is biased to approximately −600 volts. As toner from cartridges 20, 22, 24 and 26 is brought into contact with a respective one of photoconductive drums 28, 30, 32 and 34, the toner is attracted to and adheres to portions of the peripheral surfaces of the photoconductive drums that have been discharged to approximately −200 volts by the laser beams. As belt 36 rotates, in the direction indicated by arrow 48, the toner from each of drums 28, 30, 32 and 34 is transferred to the outside surface of belt 36. As a print medium, such as paper, travels along either path 50 or duplexing path 52, the toner is transferred to the surface of the print medium in nip 54.

Each of printhead portions 12, 14, 16 and 18 includes a sensor device such as sensor device 56 in printhead portion 12. Sensor device 56 is placed near the end of a scan line of the associated laser beam, and is used to determine an orientation of the laser printhead. Additionally, each of printheads 12, 14, 16 and 18 is electrically coupled to and controlled by a printhead controller 58.

Polygon mirror 60 is driven by motor 62. As polygon mirror 60 rotates, laser beams 38, 40, 42 and 44 are reflected off of a facet of polygon mirror 60 and they are directed through optical system 64, which may include lenses and other focusing optical devices. Laser beams 38, 40, 42 and 44 are also reflected off of respective mirrors and are respectively directed towards photoconductive drums 28, 30, 32 and 34.

Printhead controller 58 includes a microprocessor and data signal processing modules for processing print data received from a source computer (not shown). In addition, printhead controller 58 includes modules for processing sensor information received from sensor 56 for detecting the occurrence of a laser scan positional error.

Each of printheads 12, 14, 16 and 18 is essentially identical in structure. Accordingly, to simplify the discussion and for ease of understanding the invention, the operation of the invention will be described with respect to the structure associated with printhead portion 12. It is to be understood, however, that the discussion that follows with respect to printhead portion 12 also applies to each of printhead portions 14, 16 and 18.

Figure 2:
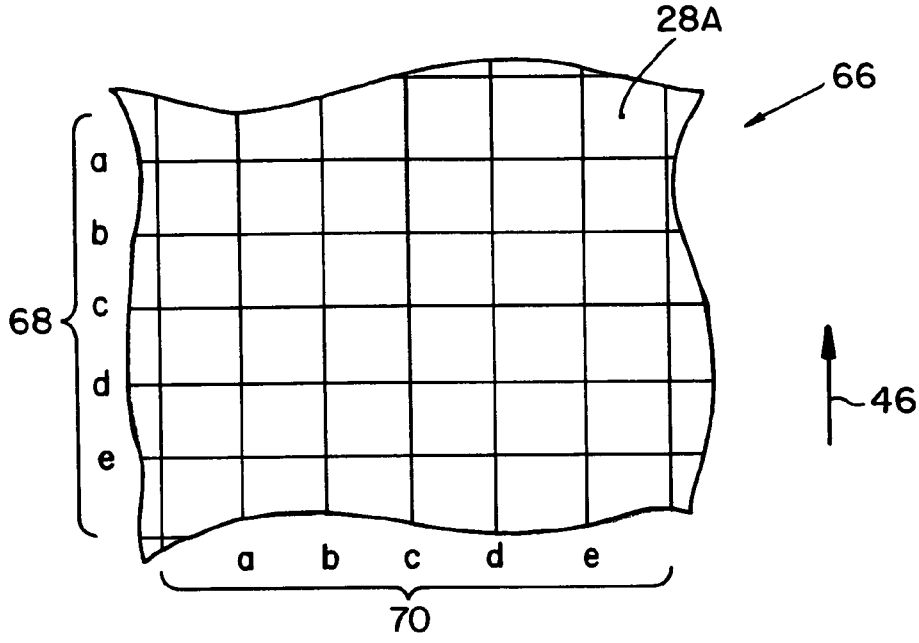
FIG. 2 is a graphical illustration of an imaginary grid defined with respect to a surface of a photoconductive drum.

Now, additionally referring to FIG. 2, there is shown an imaginary grid 66 that is defined in relation to a surface 28A of photoconductive drum 28. Grid 66 includes a plurality of rows 68 and a plurality of columns 70, wherein each intersection point of rows 68 and columns 70 define an ideal location for a center of a halftone cell. Ideally, during latent image formation on photoconductive drum 28, each of a plurality of pels is located at corresponding locations relative to the center of a halftone cell on photoconductive drum 28. However, if a printing system experiences laser scan process directional positional error such as printhead skew and laser beam optical scan path distortion, the actual location or formation of the pels on the photoconductive drum deviates from the desired location, such as that illustrated in FIG. 3.

Figure 3:
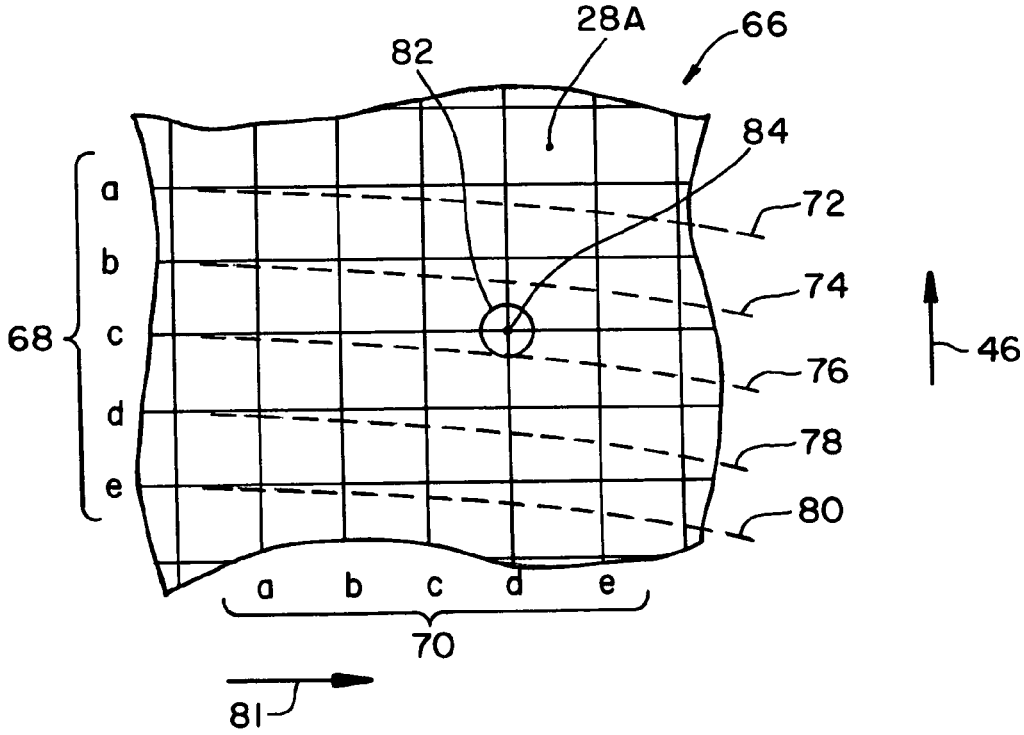
FIG. 3 illustrates an overlay of scan lines on the imaginary grid of FIG. 2.

As illustrated in FIG. 3, a plurality of substantially parallel but bowed, dashed lines represent a plurality of scan lines 72, 74, 76, 78 and 80 traced by laser beam 38, which extend in a general scan direction 81, which traverses process direction 46. As shown, the bow and skew of scan lines 72, 74, 76, 78 and 80 are highly exaggerated to illustrate the positioning problems created by laser scan process errors. Thus the actual pel locations associated with a halftone center location, which are depicted by the intersection of scan lines 72, 74, 76, 78 and 80 with columns 70*a–e* are offset in the process direction, which becomes more pronounced as laser beam 38 is scanned from left to right across photoconductive drum 28 in scan direction 81.

By way of example, assume that it is desired to form a pel of a halftone cell at a pel location having row/column coordinates of 68*c* and 70*d*. In order to minimize the effects of the laser scan errors, controller 58 controls the positioning of laser beam 38 during the scanning of adjacent pairs of scan lines 74 and 76 to offset the position of pels of a halftone cell to thereby compensate for bowed scan lines 74 and 76. The redefining of the location of pels in a halftone cell from the position of the intersection of scan line 76 and column 70*d* is accomplished by shifting a portion of a halftone cell relative to an adjacent halftone cell. Such that a pel near the center of a halftone cell is depicted as dot 82 centered at location 84.

Figure 4:
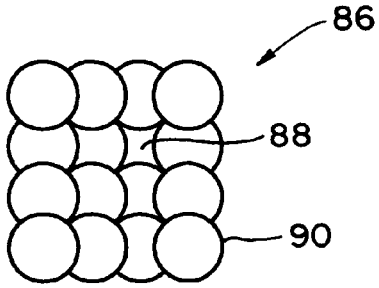
FIG. 4 illustrates a halftone cell.

Now, additionally referring to FIG. 4, there is illustrated a halftone cell including the placement of sixteen pels in a four-by-four matrix. Although halftone cell 86, as shown in FIG. 4, is made up of sixteen pels in a four-by-four matrix the method of the present invention is applicable to any sized halftone cell of a matrix of any dimension of three or greater. The pels of halftone cell 86 overlay and overlap each other and are selected to be contained in halftone cell 86 based on the intensity of the color of that portion of the image. Although the pels of halftone cell 86 appear to be overlapped in a particular order this is illustrated only in the sense that the order is shown in the manner in which the pels are selected to exist in halftone cell 86, otherwise known as halftone cell growth, and not in the order in which they are actually placed on photoconductive drum 28. For example, pel 88 appears to be the first pel in halftone cell 86 and pel 90 is perhaps the last pel of the sixteen pels included in halftone cell 86. This depicts that pel 88 would be the first pel in halftone cell selected if only one pel in halftone cell 86 is needed for the level of intensity of color, but may be the third pel printed of halftone cell 86, if the scan line proceeds from left to right. The predetermined selection of pels to be included in halftone cell 86 are selected based upon studies of the human visual system that interpret the intensity of color. One of the things that is desirable to avoid in the use of halftone imaging is the existence of connected white spaces in the color portions of an image, which is the reason that the pattern of pels in a halftone cell are selected and why adjoining halftone cells may be patterned in the same or a different manner.

Figure 5:
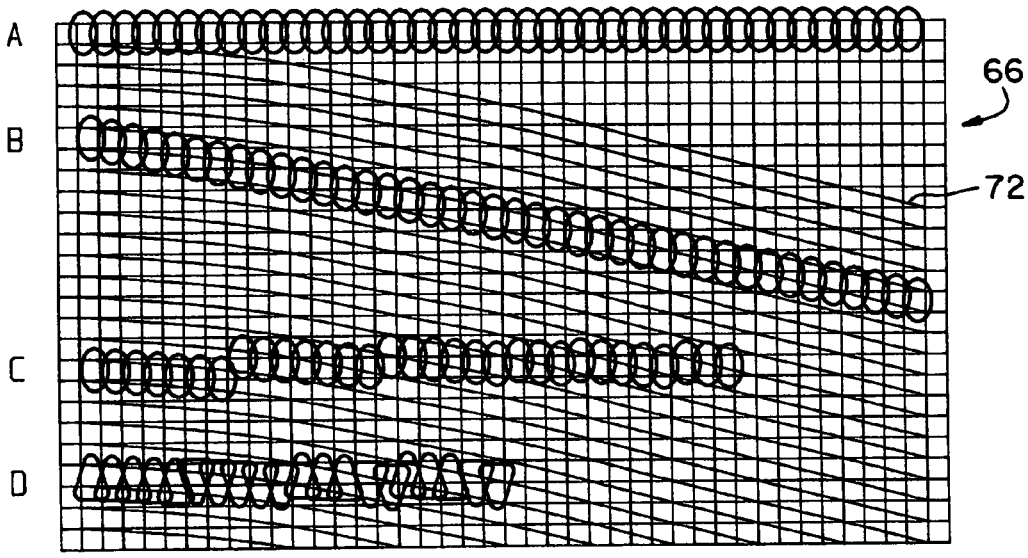
FIG. 5 illustrates a desired printing result, an uncorrected printing result, a single-scan compensation and a halftone cell compensation of the present invention.
Figure 6:
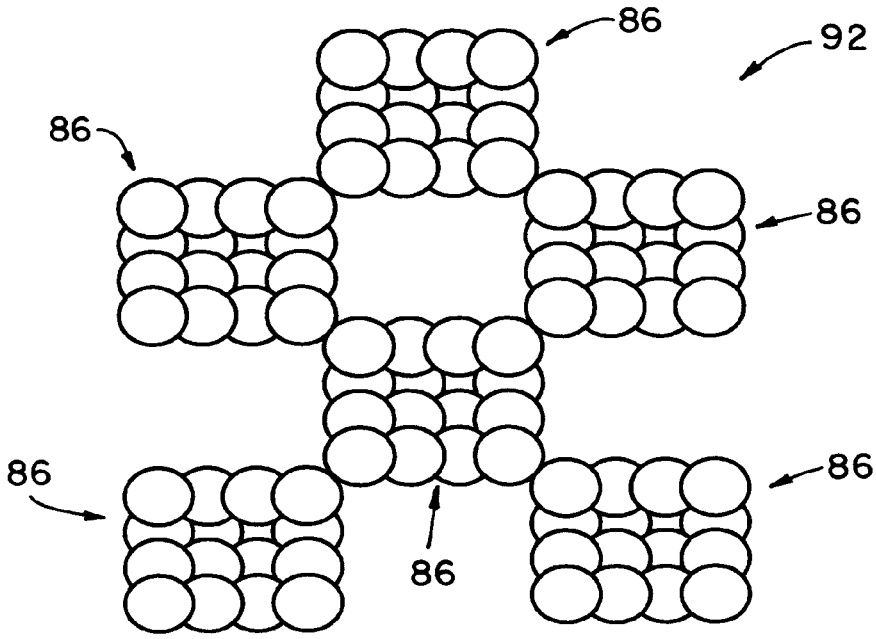
FIG. 6 illustrates a halftone pattern in a non-bowed system.
Figure 7:
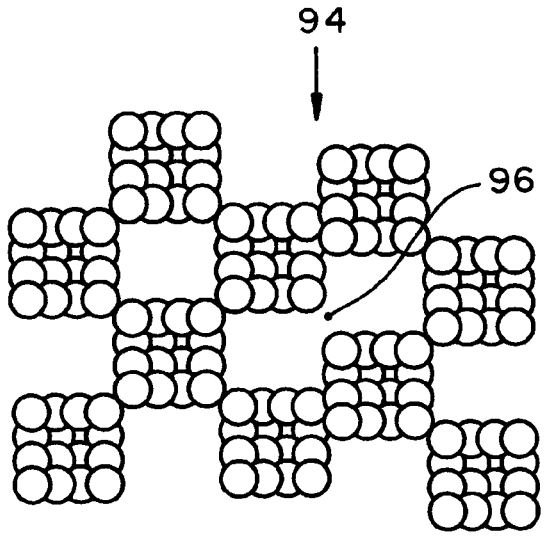
FIG. 7 illustrates a transitional shift in the halftone cell of FIG. 6.

Now, additionally referring to FIG. 5, there is illustrated in scan A the desired result of a perfect scan without any beam trajectory bowing. Scan B illustrates an uncompensated printing along a beam trajectory, which can result if there is no compensation of the bowed beam. Scan line C illustrates a correction of scan B by the shifting of data by one scan line width to compensate for the bowed beam trajectory. Scan line D represents halftone cell shifting of the present invention. Additionally, the halftone cell shifting may include the half-pel synthesized images described in U.S. Pat. No. 6,229,555, wherein synthesized pel positioning is disclosed. Positioning of halftone cells is further illustrated in FIG. 6, wherein halftone cells are illustrated in the non-bowed system, which corresponds to scan line A of FIG. 5. Halftone cell arrangement 92, in FIG. 6, is illustrated as multiple halftone cells 86 proximately positioned to render a particular color intensity. Each of halftone cells 86 may have a different total quantity of pels and are not necessarily constrained to having all sixteen pels as illustrated. It is understood that the size of halftone cells 86 are very small such that the white space between halftone cells 86 are not normally perceived by the human eye.

Figure 8:
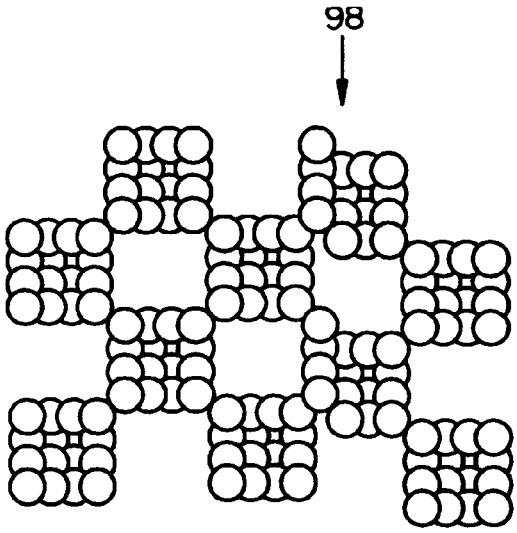
FIG. 8 illustrates another transition of the halftone cell of FIG. 6.
Figure 9:
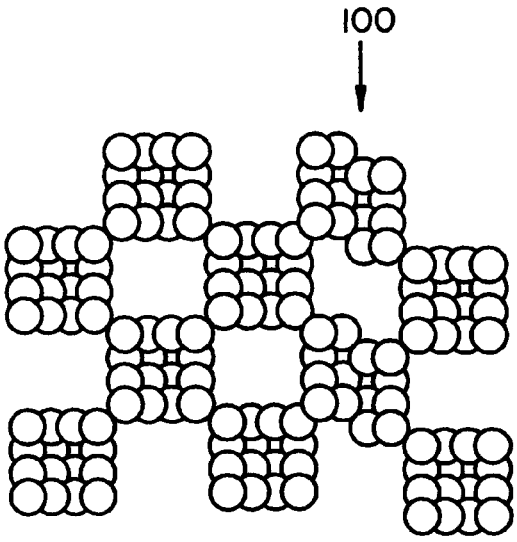
FIG. 9 illustrates another transition in the halftone cell of FIG. 6.
Figure 10:
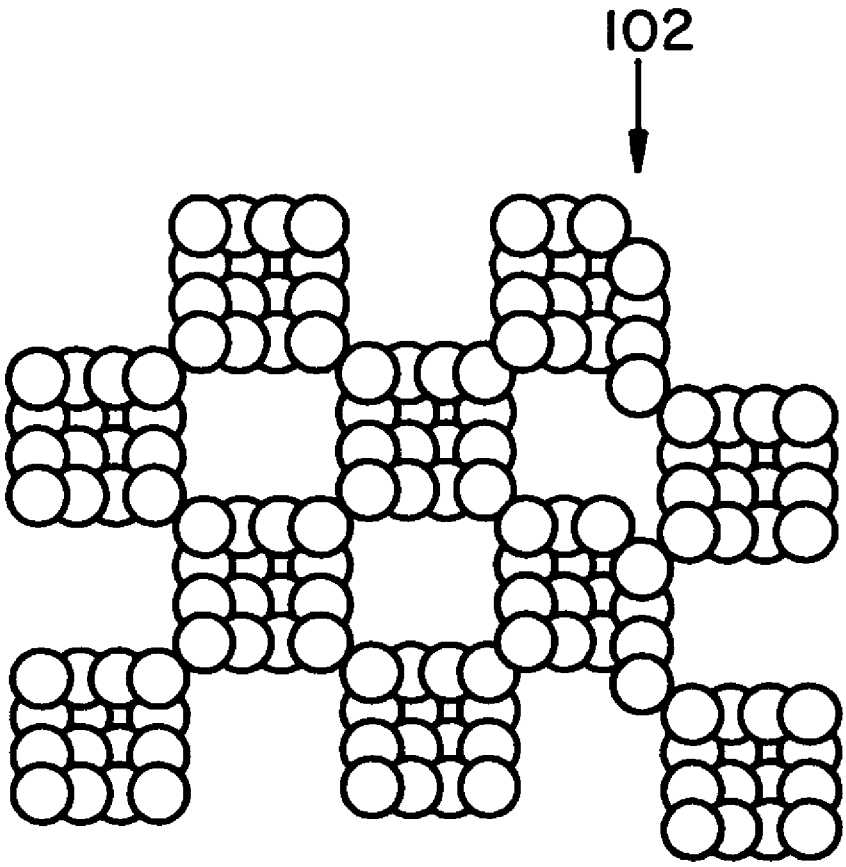
FIG. 10 illustrates yet another transition of the halftone cell of FIG. 6.

Now, additionally referring to FIGS. 7–10, there is illustrated the shifting of pels in halftone cells. More specifically in FIG. 7 there is illustrated the shifting of pels along a boundary proximately located along a border of adjacent halftone cells 86. At the location indicated by 94 there is a shifting of a column of pels that result in a connected white space 96. The connecting of adjacent white spaces, as in 96, leads to a condition that creates a visual artifact that may be perceptible by the human eye. It is the shifting of pels along a border of a halftone cell that has led to this situation. FIGS. 8-10 illustrate the shifting of pels within a halftone cell to avoid the creation of an additional visual artifact and thereby reducing the likelihood of creating a visual artifact 96 that may be perceived by the human eye. Shifting of pels at locations 98, 100 and 102 illustrate ways in which pels in halftone cells 86 may be shifted to avoid creating visual artifacts 96. The preferred method of shifting pels within a halftone cell 86 is to shift them near the center of halftone cell 86 to thereby shift the white space between halftone cells 86 without creating additional connections between white spaces and thereby creating visual artifacts such as 96. It is recognized that pels in halftone cells 86 may not all be utilized and that there may exist connecting white spaces. The method of the present invention includes shifting at the center of halftone cells to prevent the creation of additional white spaces.

Figure 11:
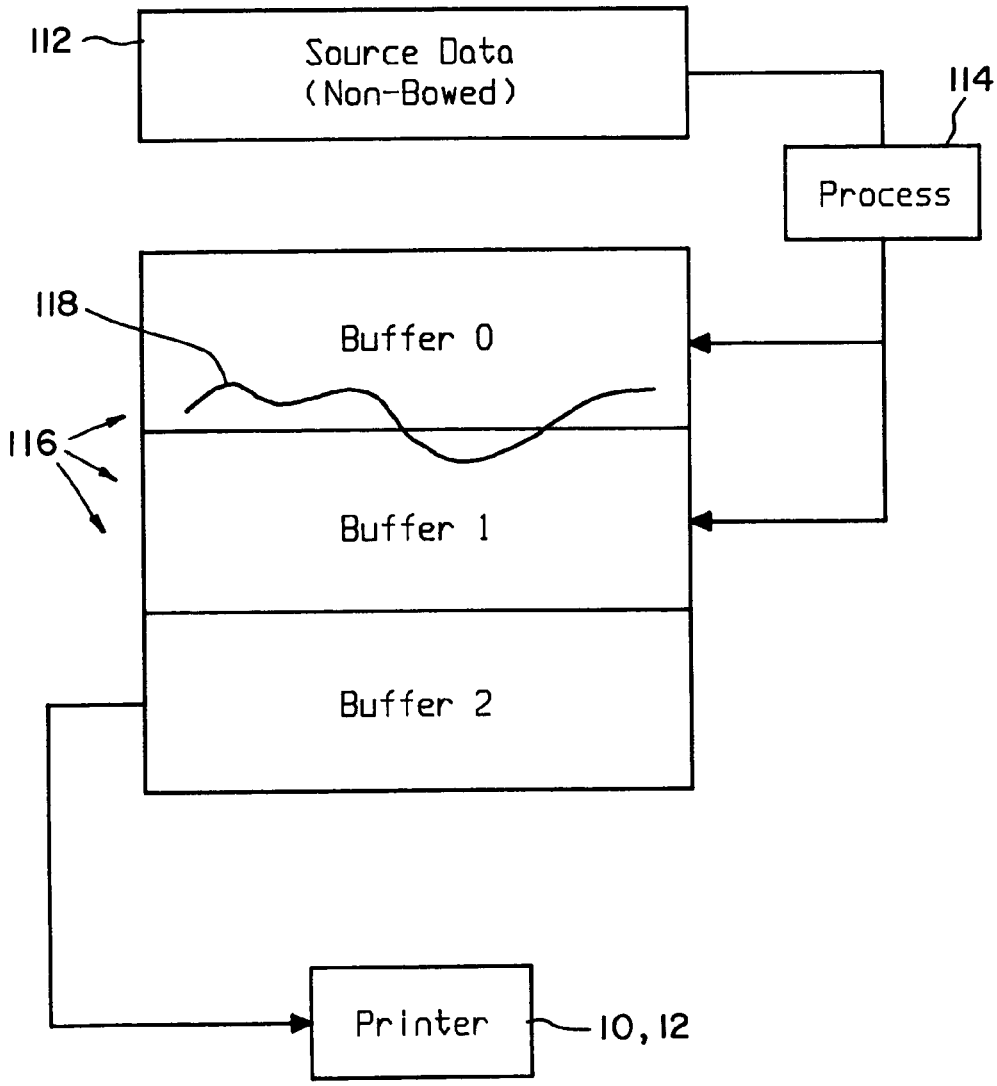
FIG. 11 schematically illustrates the bowing of non-bowed data in the present invention.

Now, additionally referring to FIG. 11, there is illustrated a printer 10 that by way of controller 58 receives uncorrected image data, also known as non-bowed image data, as illustrated in block 112. Controller 58 may process source data at block 114 and convey processed bowed data to buffer 116 for subsequent printing at printhead portion 12 of printer 10. Alternatively, source data may be placed in buffers 116 and each printhead can access buffers 116 to recall image data to be printed along beam trajectory. Line 118 schematically illustrates the position of data in buffers 116 that is utilized for a scan line. The curved nature of line 118 graphically illustrates the bowing of non-bowed data in buffers 116 to thereby allow printhead portion 12 to recall image information in buffers 116. Non-bowed data may be bowed by the transitional shifting of pels, dependent upon halftone cell location, in buffers 116. This pre-shifting of pels of an image stored in buffers 116 allows printhead portion 12 to sequentially access data in buffers 116 for printing. Additionally, data in buffers 116 may be accessed by a software pointer to gather information from buffer 116 without shifting data within buffers 116.

Figure 12:
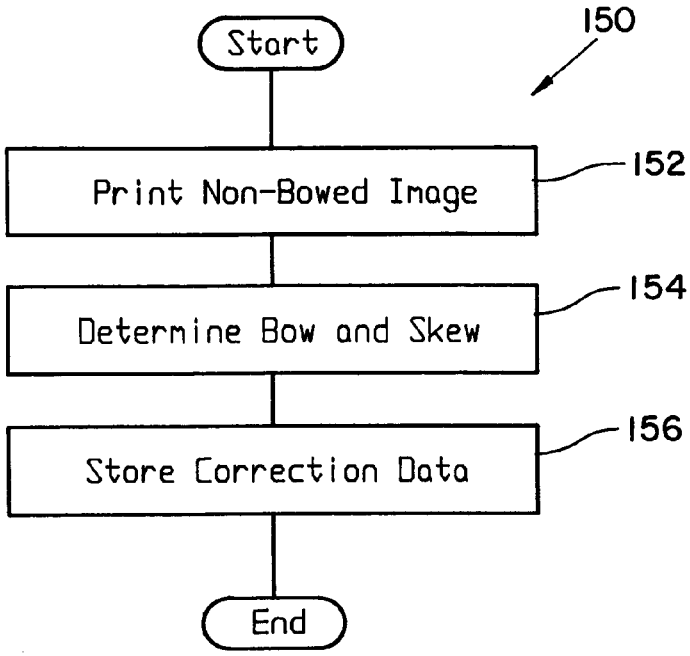
FIG. 12 illustrates a method of obtaining correction data.
Figure 13:
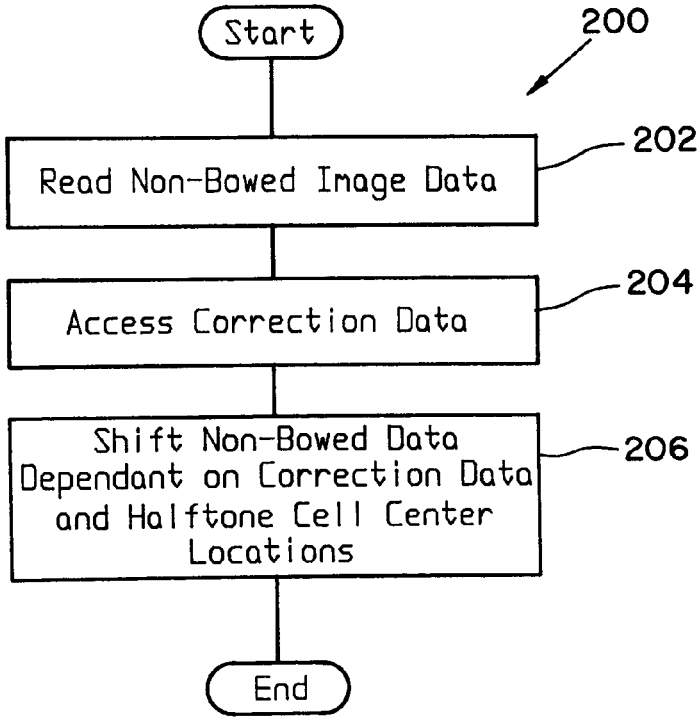
FIG. 13 illustrates a method of bowing data in the present invention.
Figure 14:
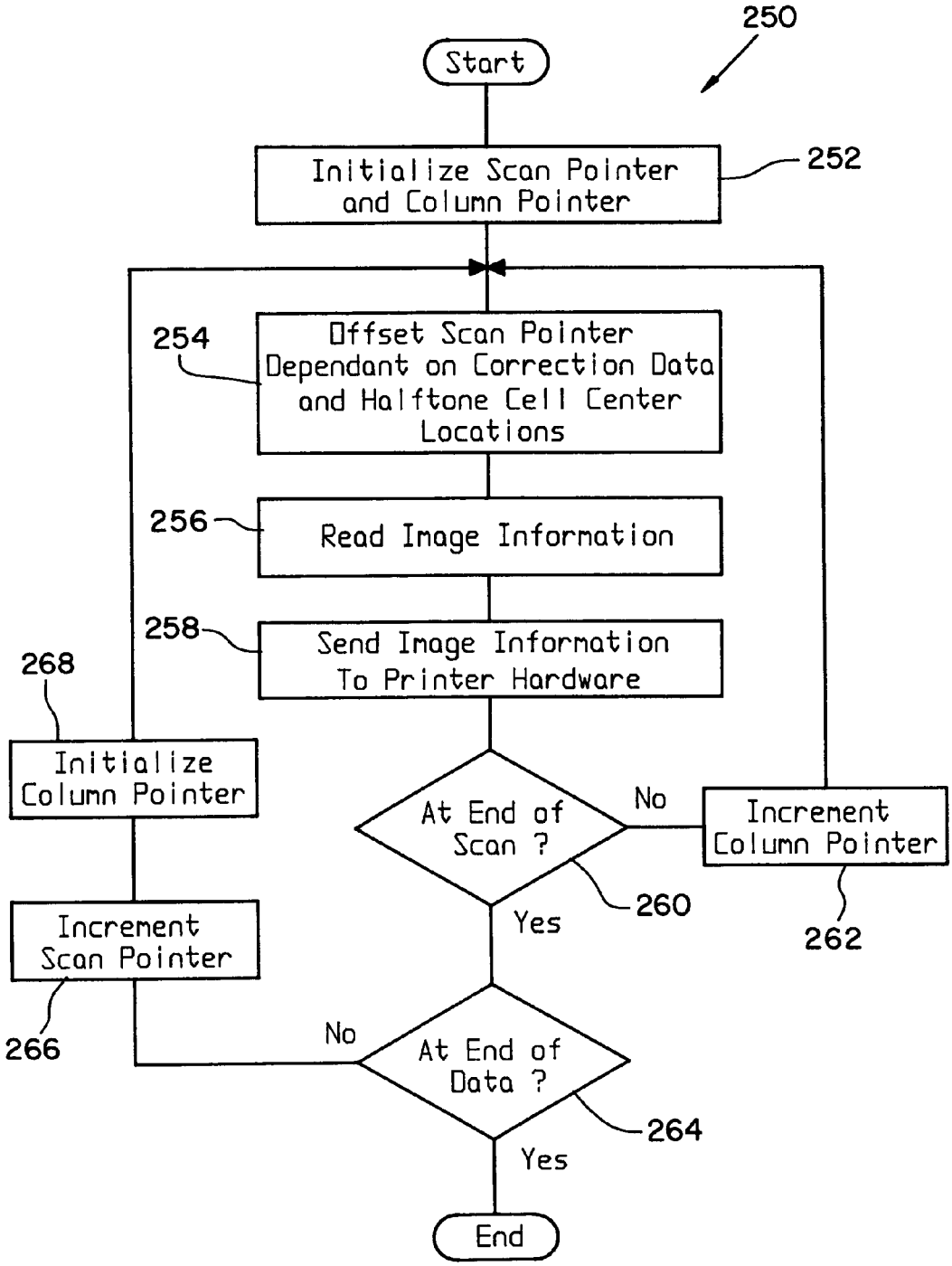
FIG. 14 illustrates a method of bowing data from non-bowed data in the present invention.

Now, additionally referring to FIGS. 12–14, there are illustrated methods 150, 200 and 250 of the present invention. Method 150 illustrates a manner in which correction data for the beam trajectory of laser beam 38 may be obtained. At step 152, printer 10 prints non-bowed image data directly upon a media, such as paper. At step 154, the bow and skew of the beam trajectory is determined from the image printed at step 152. The determination of the bow of the beam trajectory may be determined by a measurement technique or by an automatic scanning of the printed image by a device not shown. At step 156, the correction data is stored in a memory contained in controller 58. Method 150 is utilized for each of printheads 12, 14, 16 and 18 to thereby independently determine the correction data necessary for each laser printhead to thereby allow the separate correction of the laser beam trajectory for each printhead.

Method 200 illustrates a manner in which data may be shifted thereby bowing the data to compensate for a beam trajectory of laser beam 38. At step 202, non-bowed image data is read by controller 58 and placed in buffers 116.

At step 204, controller 58 accesses stored correction data, which may have been obtained in method 150. The correction data is assigned to each individual printhead and may be updated as needed or upon the replacement of particular components in printer 10.

At step 206, non-bowed data is shifted in buffers 116 to compensate for a bowed beam trajectory based upon the correction data. The correction data, as well as the nature of halftone cell growth, is taken into consideration in the shifting of non-bowed data. For example, if the correction data indicates that a shift needs to occur, the pel positioning method determines if the shift is positioned to take place at a boundary of a halftone cell. If the shift is to take place at a halftone boundary the shift is either accelerated into a previous halftone cell or delayed to the center point of the next halftone cell. The shifting of pels is preferably such that it is directed to the center point of the halftone cell to thereby reduce the number of artifacts occurring in the printed image. Additionally, a pel synthesis technique can be utilized, as described in U.S. Pat. No. 6,229,555, to shift pels a portion of a scan line.

Method 250 illustrates another manner in handling the non-bowed data in a buffer 116. Method 250 initializes a scan pointer and column pointer at step 252.

At step 254, the scan pointer is offset depending upon correction data within controller 58 and also dependent upon the location of halftone cell boundaries to thereby ensure that an offset does not occur on a halftone cell boundary but rather at a pre-determined point within the halftone cell.

At step 256, image information is read from buffers 116 based upon the position indicated by the scan pointer.

At step 258, image information read from buffer 116, dependent upon the value of the scan pointer, is sent to the printer hardware. As way of illustration, if line 118 represents a desired scan line, to be positioned on drum 28, the scan pointer points to the data along line 118 as a part of step 256. The image information sent to printer hardware 258 is then imaged upon drum 28.

At step 260, it is determined whether laser beam 38 is at the end of the scan. If laser beam 38 is not at the end of the scan, then method 250 proceeds to step 262 in which a column pointer is incremented to an adjacent column such as the columns 70 of FIGS. 2 and 3. Once the column pointer is incremented method 250 proceeds back to step 254.

If it is determined at step 260 that laser beam 38 is at the end of its scan, then method 250 proceeds to step 264. At step 264, it is determined whether all of the data held in buffer 116 has been printed. If the data has all been printed, then method 250 ends.

If more data is to be printed, method 250 proceeds to step 266. At step 266 the scan pointer is incremented to reflect a new row such as one of rows 68. Method 250 then proceeds to step 268 in which the column pointer is re-initialized to the beginning of a scan line. Method 250 then proceeds back to step 254.

Advantageously, the present invention compensates for beam trajectory bow by the shifting of non-bowed data so that information printed along a beam trajectory results in a printed image that has been compensated for, by minimizing the number of visual artifacts that are introduced by a shifting of data within a halftone cell. The growth of halftone cells is a process in which as a color intensity of a particular cell is needed to increase, a number of pels within a halftone cell are instantiated. The use of synthesized cells, as disclosed in U.S. Pat. No. 6,229,555, additionally enhances the shifting of pels within a halftone cell. Such that synthesized shifts of a portion of a pel within a halftone cell enhances a smooth transition of non-bowed data into a bowed image thus compensating a beam trajectory that is non-ideal.

The present invention has been described herein as being used in conjunction with a laser printer. However, it is to be understood that it is possible for the present invention to be adapted for use in conjunction with other types of electrophotographic imaging apparatuses, such as a copy machine. Also, the implementation described herein for minimizing visual artifacts resulting from laser scan process directional positional errors may be utilized in a scanning application to compensate for bowed scanning information that results from less than perfect optics. The compensated information results in non-bowed output information, which compensates for the optical aberrations that may be present in an optical scanner.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of minimizing visual artifacts resulting from a laser scan process in an electrophotographic machine, said electrophotographic machine including a photoconductive device having an image forming surface, said method comprising the steps of:

obtaining correction data relative to a bowed image;

offsetting at least a portion of non-bowed image data dependent upon said correction data, and additionally dependent upon halftone cell growth of a halftone cell; and accelerating a pel shift to a prior halftone cell in a scan direction of said laser beam.

2. The method of claim 1, wherein said halftone cell growth includes an order in which pels are assigned within a halftone cell.

3. The method of claim 1, wherein said halftone cell is a matrix of pels.

4. The method of claim 1, wherein said non-bowed image data is uncorrected image data.

5. The method of claim 1, wherein each said halftone cell includes a plurality of pels, at least some of said plurality of pels being arranged along at least one boundary of a corresponding one of said halftone cells.

6. The method of claim 5, wherein said plurality of halftone cells include a first halftone cell and a second halftone cell, said at least one boundary of said first halftone cell proximally aligning with said at least one boundary of said second halftone cell, thereby forming an adjacent boundary, said offsetting step not being executed relative to any pels arranged along said adjacent boundary.

7. The method of claim 1, wherein said offsetting step includes forming bowed image data as a result of said offsetting step.

8. The method of claim 7, further comprising the step of sending said bowed image data to a laser printhead.

9. The method of claim 1, wherein said pel shift occurs proximate to the center of said halftone cell.

10. A method of further minimizing visual artifacts resulting from a laser scan process in an electrophotographic machine, said electrophotographic machine including a photoconductive device having an image forming surface, said method comprising the steps of:

obtaining correction data relative to a bowed image;

offsetting at least a portion of non-bowed image data dependent upon said correction data, and additionally dependent upon halftone cell growth of a halftone cell; and delaying a pel shift to a subsequent halftone cell in a scan direction of said laser beam.

11. An electrophotographic machine having a process direction, comprising:

a photoconductive device having an image forming surface;

a printhead unit for directing a laser beam, said printhead unit including optics for scanning said laser beam to form a plurality of scan lines extending across said photoconductive drum in a scan direction which traverses said process direction; and a controller electrically coupled to said printhead unit for controlling a shifting of at least one pel in a process direction, dependent on a location of said at least one pel in said scan direction and further dependent upon a position of said at least one pel in a halftone cell, said controller accesses correction information to define said location, said controller shifts an other pel prior to said location in said scan direction.

12. An electrophotographic machine having a process direction, comprising:

a photoconductive device having an image forming surface;

a printhead unit for directing a laser beam, said printhead unit including optics for scanning said laser beam to form a plurality of scan lines extending across said photoconductive drum in a scan direction which traverses said process direction; and a controller electrically coupled to said printhead unit for controlling a shifting of at least one pel in a process direction, dependent on a location of said at least one pel in said scan direction and further dependent upon a position of said at least one pel in a halftone cell, said controller accesses correction information to define said location, said controller shifts an other pel subsequent to said location in said scan direction.

13. An electrophotographic machine having a process direction, comprising:

a photoconductive device having an image forming surface;

a printhead unit for directing a laser beam, said printhead unit including optics for scanning said laser beam to form a plurality of scan lines extending across said photoconductive drum in a scan direction which traverses said process direction; and a controller electrically coupled to said printhead unit for controlling a shifting of at least one pel in a process direction, dependent on a location of said at least one pel in said scan direction and further dependent upon a position of said at least one pel in a halftone cell, said controller changes said location if said at least one pel is on a border of said halftone cell.

14. An electrophotographic machine having a process direction, comprising:

a photoconductive device having an image forming surface;

a printhead unit for directing a laser beam, said printhead unit including optics for scanning said laser beam to form a plurality of scan lines extending across said photoconductive drum in a scan direction which traverses said process direction; and a controller electrically coupled to said printhead unit for controlling a shifting of at least one pel in a process direction, dependent on a location of said at least one pel in said scan direction and further dependent upon a position of said at least one pel in a halftone cell, said controller changes said location to a pel that is one of at a center of said halftone cell in said scan direction and proximate to said center of said halftone cell in said scan direction.

15. A method of shifting a scan line of a laser in an electrophotographic machine, said electrophotographic machine including a photoconductive device having an image forming surface with a process direction, said method comprising the steps of:

receiving non-bowed data;

shifting of at least one pel of said non-bowed data in a process direction, dependent on a location of said at least one pel in a scan direction that traverses said process direction, and further dependent upon a position of said at least one pel in a halftone cell;

outputting said at least one pel as a part of the scan line;

accessing correction information to define said location; and shifting an other pel prior to said location in said scan direction.

16. The method of claim 15, wherein said halftone cell is a matrix of pels.

17. The method of claim 15, wherein said non-bowed data is uncorrected image data.

18. A method of shifting a scan line of a laser in an electrophotographic machine, said electrophotographic machine including a photoconductive device having an image forming surface with a process direction, said method comprising the steps of:

receiving non-bowed data;

shifting of at least one pel of said non-bowed data in a process direction, dependent on a location of said at least one pel in a scan direction that traverses said process direction, and further dependent upon a position of said at least one pel in a halftone cell;

outputting said at least one pel as a part of the scan line;

accessing correction information to define said location; and shifting an other pel subsequent to said location in said scan direction.

19. A method of shifting a scan line of a laser in an electrophotographic machine, said electrophotographic machine including a photoconductive device having an image forming surface with a process direction, said method comprising the steps of:

receiving non-bowed data;

shifting of at least one pel of said non-bowed data in a process direction, dependent on a location of said at least one pel in a scan direction that traverses said process direction, and further dependent upon a position of said at least one pel in a halftone cell;

outputting said at least one pel as a part of the scan line; and changing said location if said at least one pel is on a border of said halftone cell.

20. A method of shifting a scan line of a laser in an electrophotographic machine, said electrophotographic machine including a photoconductive device having an image forming surface with a process direction, said method comprising the steps of:

receiving non-bowed data;

shifting of at least one pel of said non-bowed data in a process direction, dependent on a location of said at least one pel in a scan direction that traverses said process direction, and further dependent upon a position of said at least one pel in a halftone cell;

outputting said at least one pel as a part of the scan line; and changing said location to a pel that is one of at a center of said halftone cell in said scan direction and proximate to said center of said halftone cell in said scan direction.

* * * * *